US007163105B2

(12) United States Patent
Jameson et al.

(10) Patent No.: US 7,163,105 B2
(45) Date of Patent: Jan. 16, 2007

(54) FROTH FLOTATION PROCESS AND APPARATUS

(75) Inventors: Graeme John Jameson, New South Wales (AU); Noel William Alexander Lambert, New South Wales (AU)

(73) Assignee: The University of Newcastle Research Associates Limited (AU)

( * ) Notice: Subject to any disclaimer, the term of this patent is extended or adjusted under 35 U.S.C. 154(b) by 9 days.

(21) Appl. No.: 10/203,987

(22) PCT Filed: Feb. 15, 2001

(86) PCT No.: PCT/AU01/00145

§ 371 (c)(1),
(2), (4) Date: Oct. 7, 2002

(87) PCT Pub. No.: WO01/60523

PCT Pub. Date: Aug. 23, 2001

(65) Prior Publication Data

US 2003/0106843 A1 Jun. 12, 2003

(30) Foreign Application Priority Data

Feb. 15, 2000 (AU) ..... PQ5638

(51) Int. Cl.
*B03D 1/02* (2006.01)
*B03D 1/14* (2006.01)

(52) U.S. Cl. ..... 209/164; 209/168; 209/170; 239/498; 239/499; 239/524

(58) Field of Classification Search ..... 209/164, 209/168, 169, 170; 239/498, 499, 524
See application file for complete search history.

(56) References Cited

U.S. PATENT DOCUMENTS

| | | | | | |
|---|---|---|---|---|---|
| 291,107 | A | * | 1/1884 | Tobin | 239/498 |
| 696,057 | A | * | 3/1902 | Lanstrum | 239/524 |
| 2,005,742 | A | * | 6/1935 | Hines | 162/5 |
| 2,550,456 | A | * | 4/1951 | De Flon | 239/498 |
| 2,724,614 | A | * | 11/1955 | Rider | 239/498 |
| 3,221,995 | A | * | 12/1965 | Sievert | 239/452 |
| 3,371,779 | A | * | 3/1968 | Hollingsworth | 209/166 |
| 4,113,021 | A | * | 9/1978 | Werner | 169/37 |
| 4,205,785 | A | * | 6/1980 | Stanley | 239/17 |

(Continued)

FOREIGN PATENT DOCUMENTS

WO 99/61699 * 12/1999

OTHER PUBLICATIONS

Supplementary Partial European Search Report. 4 pages.

*Primary Examiner*—Thomas M. Lithgow
(74) *Attorney, Agent, or Firm*—Ostrolenk, Faber, Gerb & Soffen, LLP

(57) ABSTRACT

A froth flotation process typically used to separate particulate materials such as coal, has a mixed size feed (1) separated in a sieve bend (2) into a stream of relatively fine particles (3) and a stream of relatively coarse particles (14). The fine particles are fed to a flotation cell (7) in the normal manner, while the coarse particles are mixed with wash water (16) and distributed onto or into the froth layer (10) by wash water distribution apparatus (19, 20). Alternative variations of wash water distribution apparatus able to handle coarse particles are also described.

22 Claims, 2 Drawing Sheets

U.S. PATENT DOCUMENTS 4,523,991 A 6/1985 Meyer et al. ..... 209/166
4,564,369 A * 1/1986 Burgess et al. ..... 44/629
4,592,834 A 6/1986 Yang ..... 209/166
4,659,458 A 4/1987 Chin et al. ..... 209/164
4,997,549 A * 3/1991 Atwood ..... 209/164
5,066,389 A * 11/1991 Zlobin et al. ..... 209/170
5,116,487 A 5/1992 Parekh et al. ..... 209/164
5,152,458 A * 10/1992 Curtis ..... 239/222.17
5,167,798 A 12/1992 Yoon et al. ..... 209/170
5,234,111 A * 8/1993 Zlobin et al. ..... 209/168
5,277,317 A * 1/1994 Zlobin et al. ..... 209/164
6,413,366 B1 * 7/2002 Kemper ..... 162/60

* cited by examiner

FROTH FLOTATION PROCESS AND APPARATUS

FIELD OF THE INVENTION

The present invention relates to a froth flotation process and apparatus in which small air bubbles are used in a flotation cell to selectively separate particles such as fine coal or minerals from unwanted material. It also relates to a process and apparatus for the distribution of water or slurry on top of the froth in such froth flotation processes.

BACKGROUND OF THE INVENTION

In a froth flotation process, the material to be processed is present in a suspension in water. A reagent is added which renders the particles to be separated hydrophobic or non-wetting with water. This reagent is known as a "collector". Air bubbles are introduced into the suspension in a flotation cell or column, and on being brought into contact with the particles by collision, attach to the hydrophobic particles and carry them to the surface of the liquid where they form a froth. The froth layer flows out of the flotation cell into a froth overflow launder. The particles which have not adhered to bubbles flow out of the cell in a tailings stream. The unwanted particles are typically referred to as the "gangue" (in minerals) or "ash" (in coal processing) particles.

The flotation process is typically applied in the coal and minerals industries, to particles less than 300 to 500 micrometers in diameter. In some cases, it would be advantageous to be able to recover particles larger in size, especially in coal processing, where particles in the range 300 to 2000 micrometers are typically separated using other technologies, which exploit the difference in density between the coal and the ash material. Flotation has not generally been applied to the flotation of particles above 300 to 500 micrometers, because the efficiency of recovery of valuable particles above this size is typically very low. The reason is that in normal flotation, the particles to be separated and recovered must first become attached to air bubbles which lift them out of the slurry in the flotation cell and into the froth layer above the slurry.

It will be appreciated that in order to rise, the density of the bubble-particle aggregate must be less than that of the surrounding slurry, and the larger the particles, the larger must be the total volume of gas bubbles attached to the particles to achieve buoyancy. In practice, it is observed that aggregates which form between large particles and single bubbles or clusters of bubbles are easily dispersed by the fluid mechanical forces due to turbulence in the slurry in the flotation cell. Accordingly, there is a high probability that particles larger than 300 to 500 micrometers in diameter will remain in the slurry and pass out of the cell with the gangue or ash material in the tailings, even though they may be truly hydrophobic.

One way of improving the flotation of coarse particles is to introduce them into the froth layer on top of the flotation cell. If such particles, which have already been made hydrophobic by suitable treatment with a collector, can make contact with the bubbles in the froth, there is a high probability that they will remain in the froth and be recovered into the froth overflow launder, whereas coarse particles of gangue or ash material will pass through the froth into the slurry below, to be discharged with the tailings.

A difficulty with the attempts that have been made in the past to float coarse particles in the froth, is that the slurry incorporating the coarse particles was introduced on to the upper surface of the froth from a central distribution point. However, this results in a very uneven distribution of coarse particles in the froth and has not been found to be effective.

One of the problems inherent in the froth flotation process is the entrainment of unwanted matter by the bubbles rising into the froth layer. These particles report to the froth concentrate leaving the cell, and cause a reduction in the quality or grade of the flotation product. In general, the amount of entrainment in the froth concentrate is proportional to the volume of water recovered in the froth. One way of reducing or eliminating the amount of entrained material is to apply wash water to the top of the froth. The wash water drains downward in the froth layer, and flushes the unwanted particles back into the flotation cell, whereas the hydrophobic particles, being attached to the bubbles, are able to flow upwards and out of the cell.

The means for the distribution of wash water in flotation cells typically consists of a shallow tray drilled with small holes at regular intervals, and placed a short distance above the froth layer. Water is fed to the tray, and passes through the holes to form a multiplicity of jets or droplet streams which fall on top of the froth. Variations include systems of perforated pipes which can be placed above or within the froth layer. Water is introduced into the pipes, and flows or drips out of the perforations in the pipe wall, into or above the froth. It will be understood that any apparatus involving the passage of the wash water through small holes or orifices will be prone to blocking by adventitious particles which may be present in the wash water, giving rise to a reduction in the efficiency of distribution of the wash water, and requiring frequent maintenance and inspections to prevent or remove blockages.

In practice, it can be difficult to obtain clean process water in coal washeries and mineral concentrator plants for use as wash water. Often, the process water is obtained as the overflow from thickeners or settling ponds, and if there is a malfunction in the plant which interrupts the water clarifying process, the water which is recirculated back into the plant can contain significant quantities of fine particles, sometimes as much as five to ten percent by weight. These particles can settle readily in regions of low velocity in the wash water delivery pipes, or in wash water trays, and block the holes or perforations intended to allow the water to be distributed in the froth. It would be advantageous to be able to supply a process and apparatus for distribution of wash water which was not prone to blockage by small particles and which is capable of operating for long periods without failure due to blockage of holes.

DISCLOSURE OF THE INVENTION

Accordingly, in one aspect, the invention consists in a method of distributing particles into a froth layer in a froth flotation separation process, comprising the steps of:

generating a froth layer including particles adhered to bubbles in the froth, sustaining the froth layer by providing a supply of bubbles rising into the froth layer;

providing the process with a supply of liquid, and apparatus arranged to distribute the liquid in an array of streams into or onto the froth layer, adding further particles to the flow of liquid as part of the separation process, and distributing the liquid containing the further particles into or onto the froth layer as a separate step to said step of generating a froth layer.

Typically the particles comprise relatively coarse particles of at least 100 micrometers in diameter.

Preferably the froth flotation separation process has a feed slurry containing a wide size distribution of particles, and wherein those particles are subjected to a size-based separation, the slurry containing the relatively smaller size fraction of feed particles being fed into the froth flotation separation process as a conventional feed slurry, and the relatively larger size particles comprising said relatively coarse particles being added to the liquid.

Preferably the relatively coarse particles are of at least 300 micrometers in diameter.

Preferably the liquid comprises wash water.

Preferably reagents are added to the liquid, chosen to facilitate the attachment of particles to air bubbles in the froth.

Preferably the liquid is conditioned after the particles are added to the flow of liquid, and the reagents may comprise collectors, frothers, and other flotation modifiers.

In one form of the invention the liquid containing the particles is distributed into or onto the froth layer by providing a plate-like surface located above the froth layer and extending over at least part of the surface of the froth, and wherein the method includes the step of directing a jet of liquid onto the plate-like surface in such a manner that the liquid is caused to be distributed over the plate-like surface, striking the fingers and falling therefrom in a plurality of streams.

Preferably the plate like surface is provided with a plurality of downwardly extending fingers.

Preferably the plate-like surface is orientated substantially horizontally above the froth layer and the jet of liquid is directed substantially vertically upwardly onto the plate-like surface.

When the liquid containing the particles is distributed directly into the froth layer, the fingers are sized and positioned to extend downwardly into the froth layer in use.

In an alternative form of the invention the liquid containing the particles is distributed onto the froth layer by providing a tray adapted to contain the liquid extending substantially horizontally above the surface of the froth layer, the tray having an array of holes therethrough, pouring or otherwise distributing the liquid into the tray such that the liquid containing the particles is caused to drain through the holes and fall upon the froth layer, and vibrating the tray in such a manner as to shake loose particles which become caught in the holes in the tray.

Preferably the amplitude and frequency of vibration is selected to minimise blocking the holes in the tray by the particles.

In a further aspect, the invention consists of apparatus for distributing liquid over the froth layer in a froth flotation separation process, said apparatus comprising a plate-like surface adapted to be positioned above the froth layer, and a nozzle arranged to direct a jet of liquid against the surface such that the liquid is caused to be distributed over the surface, striking the fingers and falling therefrom in a plurality of streams.

Preferably the plate-like surface is provided with a plurality of downwardly extending fingers arrayed such that in use, the liquid distributed over the surface strikes the fingers and falls therefrom in said plurality of streams.

Preferably the fingers each comprise rods or the like located in a predetermined array across the surface.

Preferably the array is predetermined to give an even distribution of liquid streams across the surface of the froth layer.

Preferably the plate-like surface is provided with a peripheral downwardly extending flange arranged to contain the liquid distributed over the surface from the jet.

Preferably the fingers are formed from a flexible material, able to bend with movement of the froth layer against the fingers.

In a still further aspect, the invention consists in apparatus for distributing liquid over the froth layer in a froth flotation separation process, said apparatus comprising a wash water tray having an array of holes therein, positioned above the surface of the froth layer;

means to supply liquid to the wash water tray; and vibration means operatively connected to the wash water tray and adapted to vibrate the wash water tray in a manner predetermined to shake loose any particles in the liquid which might block the holes in the tray.

Preferably the wash water tray is supported by suitable suspension means allowing the tray to be vibrated by the vibration means.

Preferably the vibration means comprise an electric motor rotating an eccentric weight.

BRIEF DESCRIPTION OF THE DRAWINGS

Notwithstanding any other forms that may fall within its scope, one preferred form of the invention, and variations thereof, will now be described with reference to the accompanying drawings in which.

PREFERRED EMBODIMENTS OF THE INVENTION

We have discovered that it is advantageous to take advantage of the wash water often present in a flotation process to act as a means of conveying coarse coal particles and distributing them over the surface of the froth in the flotation cell. Thus, when the flotation feed is split on a size basis by convenient means, the fine particles are introduced to the flotation cell and are floated by suitable existing means, and the coarse particles are mixed with clean wash water, and distributed over the surface of the froth. If the size separation is done by screening, the coarse particles will be relatively free of gangue or ash slimes. The coarse coal particles attach to the bubbles in the froth, and the gangue material percolates with the wash water through the froth and into the underlying liquid layer. It is therefore part of the invention disclosed here, to mix the coarse particles to be floated with clean wash water for purposes of distribution into or over the top of the froth.

Throughout this specification, the term "wash water" is used to describe the liquid feed into the froth in the flotation process, and in the ideal form of the invention this feed would typically comprise pure wash water. It is however recognised that it is already common practice in mineral processing plants to draw wash water which ought to be clean but isn't, from settling ponds and thickeners, recycling it back to the flotation plant for distribution over the surface of the flotation froth as wash water. It is also possible that the coarse particles could be distributed into the froth in a liquid of other characteristics as part of another process, and for both of the forgoing reasons it is therefore to be understood that the term "wash water" when used in this specification, although ideally relating to a pure water feed, also encompasses other liquids incorporating particles or other impurities.

Figure 1:
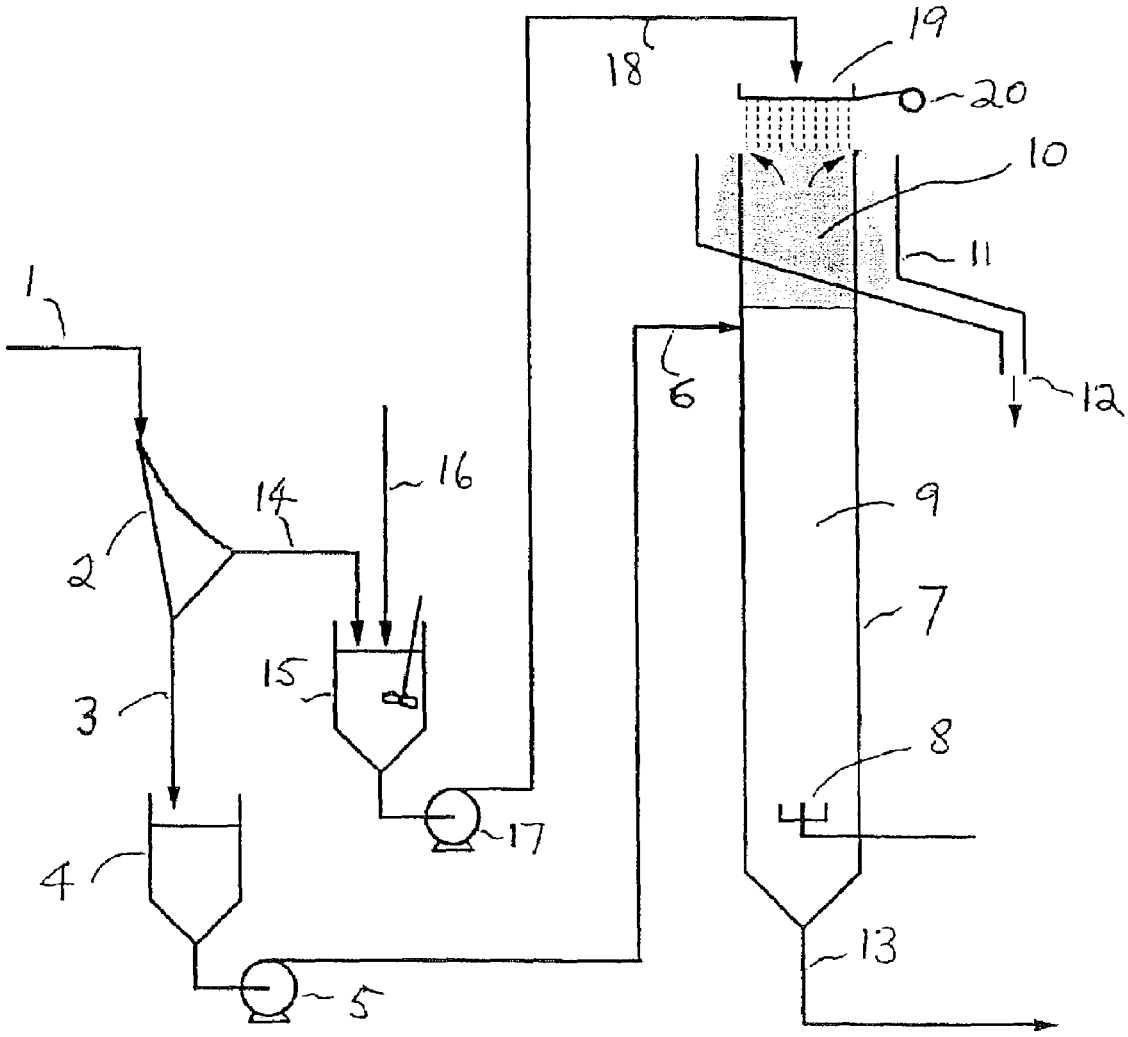
FIG. 1 is a diagrammatic representation of a froth flotation separation process for coarse coal flotation using the method and apparatus according to the present invention.

Turning firstly to FIG. 1 there is shown diagrammatically a flotation plant set up to demonstrate the flotation of coarse particles by distributing those particles with the wash water on to the upper surface of the froth layer in a froth flotation process.

Prior to entry to the flotation process, the feed is conditioned by addition of collectors and frothers and other reagents as appropriate. The feed to the plant enters at 1, and flows to a suitable size-separation means 2, which may conveniently be a sieve bend or a vibrating screen. The particles of sizes below the cut point of the separation device discharge from the sieve bend at 3, into a pump box 4, from which they pass through the pump 5 to a feed distributor 6 and into the flotation cell 7.

In an alternative process, appropriate conditioning reagents may be introduced separately to the streams containing the undersize and oversize particles, for example, in the pump boxes 4 and 15.

In the separation of coal and other minerals, the fine feed particles are typically less than 200–300 micrometers in diameter.

The flotation cell 7, may for example be a flotation column provided with flotation feed at 6. Air is injected into the column through an aeration device at 8, and the bubbles formed rise through the column, contacting the particles to be floated and carrying them to the surface of the liquid layer 9 and into the froth zone 10.

As is conventionally known, the foam forms a froth layer 10 on the top of the cell which overflows into a launder 11 where it is taken off through outlet channel 12. The tailings from the flotation cell 7 are withdrawn at 13.

The overflow from the sieve bend 2 contains the coarse particles in a substantially de-watered form. The overflow discharges through a conduit 14 into a sump 15 where it is formed into a slurry by mixing with a stream of wash water 16. The wash water should preferably be free of suspended solids, but in practice, it may contain fine solids that have been carried over from the processes in another part of the mineral processing plant.

The suspension of coarse particles in wash water pass through the pump 17 to the wash water distribution pipe 18, which feeds the wash water tray 19 at the top of the flotation column 7.

The wash water tray 19 may be conventional in most aspects, but is additionally provided with a vibrator 20 connected to the wash water trays so as to vibrate the tray in use.

It has been found that by vibrating the wash water trays, blockage of the holes in the trays from the coarse particles fed with the wash water is inhibited or prevented from allowing continuous use of the process. The vibration may be formed in any known way but is typically provided by an electric motor, rotating an out of balance weight.

Alternatively, and in a more preferred form of the invention, the wash water distribution trays may be replaced by a wash water distributor consisting essentially of a jet of wash water, which may or may not contain particles in suspension, which is directed vertically upwards against a flat horizontal plate-like surface located above the froth layer. Surprisingly, it is found that the vertically impinging jet spreads radially outwards to form a relatively thin liquid film. If no obstacles are put in its way, the liquid film moves radially outwards until some natural limit is reached, the film becomes unstable, and at a well-defined radius here designated as R, it thickens and falls downward under gravity in the form of a series of jets or streams of droplets, distributed around the periphery of a circle centred on the point of impingement of the jet.

Figure 2:
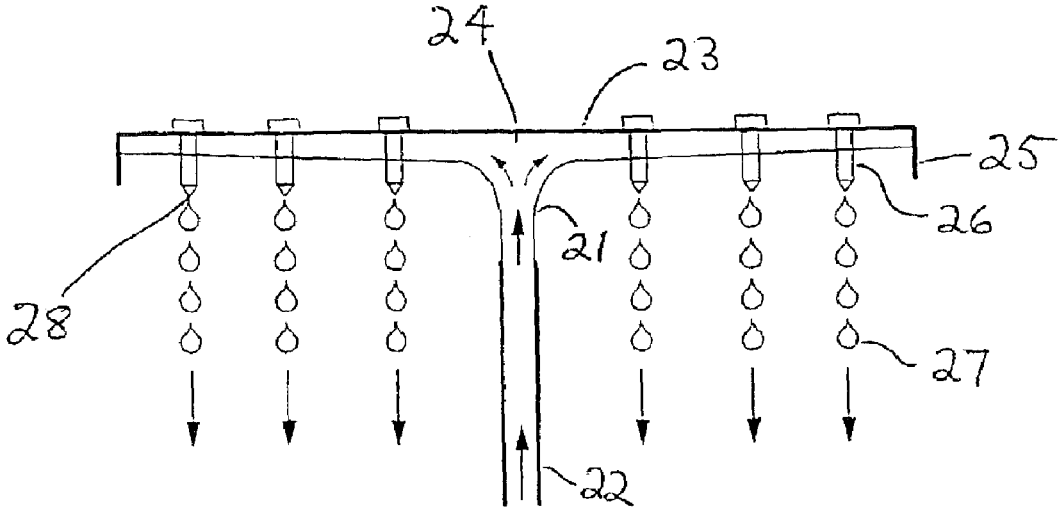
FIG. 2 is a vertical cross section to an enlarged scale through one form of wash water distribution apparatus according to the present invention.
Figure 3:
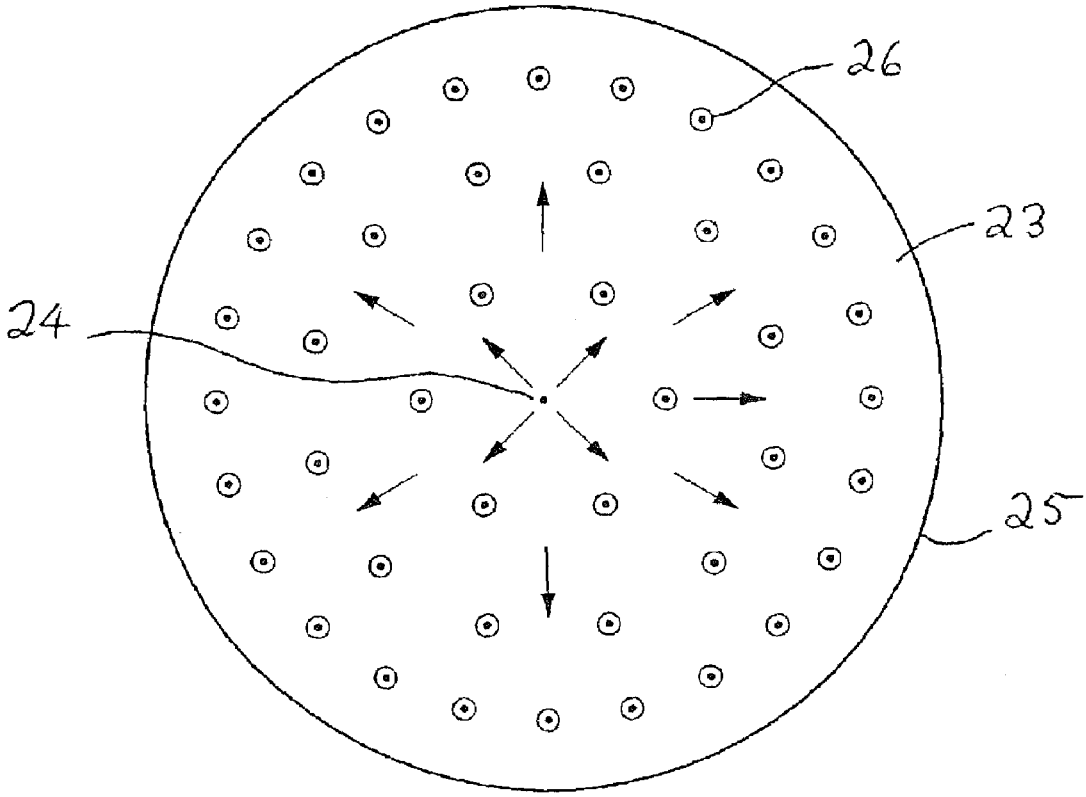
FIG. 3 is a diagrammatic underside view of the apparatus shown in FIG. 2.

Turning to FIGS. 2 and 3, it can be seen that a jet of liquid 21 to be distributed over the surface of the froth is directed by an entry pipe 22 so as to impinge vertically on the underside of an essentially flat plate 23, at a stagnation or impingement point 24. The flat plate is conveniently limited at its external radius by a vertical wall 25. In order to improve the distribution of streams falling from the plate, an array of downwardly extending fingers in the form of vertical rods 26 is located in the tray 23. Each rod 26 acts as an obstacle to the radial flow of the liquid, and liquid which collides with the rod flows vertically down the rod, to depart in the form of a small jet or droplet stream 27 from the tip 28 of the rod. The rod may be a conveniently-formed object, such as a screw or bolt protruding form the under surface of the tray 23, or be any other suitably shaped obstacle.

In principle, the rods or obstacles 26 should be distributed evenly over the surface of the distributor tray, in such a way that the radial path to each one from the origin of flow at the impingement point 24 is unimpeded. However it has been found in practice that the liquid tends to flow around each obstacle and recombine in its wake, without serious detriment to the operation.

The fingers may be rigid, or formed from a flexible material, able to bend with transverse movement of the froth layer against the fingers.

The boundary wall 25 is provided to confine the liquid and to prevent splashing outside the bounds of the tray caused by chance upsets to the flow stream. The wall 25 is conveniently placed at approximately the same radius from the impingement point 24 as the natural limiting radius R of the outwardly-moving liquid film in the absence of the drip rods 26. By selection of the number and diameter of the individual rods 26 and their spacing relative to each other, it is possible to arrange for all of the flow in the incoming jet 21 to be diverted to flow downwards off the tray, before the liquid film reaches the boundary wall 25.

It should be noted that the smallest hole or orifice in this system is the delivery pipe 22 through which the liquid is introduced to the tray. Since the whole flow must pass through this pipe, it will conveniently be much larger than the size of the largest particles to be expected in the stream of wash water.

It will be appreciated that in some circumstances it will not be possible for one tray as shown in FIGS. 2 and 3, to provide full coverage of the froth for a given flotation cell. In such cases, a multiplicity of such trays can be provided so as to give essentially unfirm distribution over the whole cell area. It will also be appreciated that in some circumstances it will not be possible for the flow from a single jet to supply the wash water requirements for a given flotation cell, and in such cases, a multiplicity of jets impinging on one or more trays can be provided so as to provide essentially uniform distribution over the whole cell area.

Although the wash water distribution tray depicted in FIGS. 2 and 3 has been shown as if it were circular in form, it will be appreciated that the shape could be square, rectangular, trapezoidal or of other form suitable for the application. Where the shape is not circular, it is desirable that the maximum radial distance from the impingement point 24 is less than the maximum natural radial distance R, as otherwise the liquid film will not reach the outermost rods.

Whether the coarse particles are distributed with the wash water by way of the apparatus shown and described with reference to FIGS. 2 and 3, or by way of conventional wash water trays 19 provided with vibrators 20 (FIG. 1) the method and apparatus according to the invention enables relatively coarse particles (typically greater in size than 200–300 micrometers) to be evenly distributed into the upper surface of the froth layer in the flotation cell 1.

Tests conducted in laboratory-type situations have shown that it is possible to recover coal particles at very high yields and combustibles recoveries. Results from test work carried out on this apparatus support the view that when coarse floatable particles are fed on top of the froth and evenly distributed in the wash water or other liquid, there is a high probability that they will report to the product.

Although it is believed that the distribution of coarse particles of sizes 100 micrometers and up is effective using this method, in a commercial situation the relatively coarse particles would be of a size at least 300 micrometers in diameter. In the following example, the feed of coal containing a wide range of particle sizes has been separated with particles greater than 500 micrometers in diameter introduced to the flotation cell on top of the froth and particles less than that size fed as the feed slurry into the cell in the conventional manner.

EXAMPLE

A plant was modified in accordance with the invention, and a feed of coal containing a wide range of particle sizes was fed to the unit. The suspension of feed coal at 5 percent W/W was conditioned with diesel oil (1 kg/tonne) and MIBC (methyl isobutyl carbinol) frother (15 gm/tonne of feed liquid). A sieve bend of nominal aperture 500 μm was used to separate the feed particles. The mass of feed above 500 μm in diameter was 16 percent. The coarse coal was distributed over the froth in the wash water. The superficial velocity of the air in the flotation cell ($J_G$) was 1.2 cm/s, and the superficial velocity of the wash water applied to the cell ($J_L$) was 1.1 cm/s. Analysis of the various streams on a size-by-size basis gave the results shown in Table 1. The recovery of the coarse combustibles was very high, almost matching the recoveries of the sub-500 μm particles.

TABLE 1

| Size Under μm | Size Over μm | Feed Ash | Concentrate Ash % | Tailings Ash % | Mass Yield % | Combustibles Yield % |
|---|---|---|---|---|---|---|
| | >2000 | 6.82 | 3.97 | 27.33 | 88 | 91 |
| 2000 | 1400 | 7.04 | 4.40 | 38.92 | 92 | 95 |
| 1400 | 100 | 8.62 | 5.33 | 47.05 | 92 | 95 |
| 1000 | 710 | 9.30 | 5.59 | 54.81 | 92 | 96 |
| 710 | 355 | 11.24 | 6.78 | 72.24 | 93 | 98 |
| 355 | 90 | 20.71 | 12.92 | 86.74 | 89 | 98 |
| 90 | 0 | 46.71 | 29.14 | 66.60 | 53 | 71 |
| Overall | | 15.1 | 9.7 | 75.6 | 92 | 98 |

It is believed that the froth layer 10 formed on the top of the flotation cell 7 in a conventional flotation process is inherently a very stable and strong froth due to the fine particles which are adhered to the bubbles in the froth, and that a froth of this nature is therefore able to withstand the introduction of relatively coarse particles with the wash water as described above, supporting and floating those relatively coarse particles along with the fine particles into the launder 11. The utilisation of this understanding, results in a process which is commercially very efficient in allowing relatively coarse particles to be recovered along with the relatively fine particles.

The invention claimed is:

1. A froth flotation separation process of the type utilizing wash water to wash particles through froth layer, said process comprising the steps of:

generating a froth layer including particles introduced in the generation of the froth layer, sustaining the froth layer by providing a supply of bubbles rising into the froth layer;

providing a supply of wash water;

mixing further particles with the wash water and distributing the wash water containing the further particles into or onto the froth layer in an array of streams as a separate step to the step of generating a froth layer.

2. A process as claimed in claim 1 wherein the further particles comprise relatively coarse particles of at least 100 micrometers in diameter.

3. A process as claimed in claim 2 wherein the froth flotation separation process has a feed slurry containing a wide size distribution of particles, and wherein those particles are subjected to a size-based separation, the slurry containing the relatively smaller size fraction of feed particles being fed into the froth flotation separation process as a conventional feed slurry, and the relatively larger size particles comprising the relatively coarse particles being distributed in the wash water.

4. A process as claimed in claim 2 wherein the relatively coarse particles are of at least 300 micrometers in diameter.

5. Apparatus for distributing liquid over the froth layer in a froth flotation separation process, the apparatus comprising:

a plate-like surface adapted to be positioned above the froth layer; and a nozzle arranged to direct a jet of liquid upwardly against an underside of the surface such that the liquid is caused to be distributed over the surface, and to fall from the surface in a plurality of streams, wherein:

the plate-like surface is provided with a plurality of downwardly extending fingers arrayed such that in use, the liquid distributed over the surface strikes the fingers causing the liquid to fall from the surface in the plurality of streams; and the fingers are formed from a flexible material which are able to bend with movement of the froth layer against the fingers.

6. A process as claimed in claim 1 further comprising adding reagents to the wash water chosen to facilitate the attachment of particles to air bubbles in the froth.

7. A process as claimed in claim 6 further comprising conditioning the wash water after the particles are added to the flow of wash water.

8. A process as claimed in claim 6 wherein the reagents are selected from a group consisting of collectors, frothers, and other flotation modifiers.

9. A froth flotation separation process comprising the steps of:

generating a froth layer including particles introduced in the generation of the froth layer, sustaining the froth layer by providing a supply of bubbles rising into the froth layer;

providing a supply of liquid;

mixing further particles with the liquid; and distributing the liquid containing the further particles into or onto the froth layer in an array of streams as a separate step to the step of generating the froth layer, wherein:

the liquid containing the particles is distributed into or onto the froth layer by providing a plate-like surface located above the froth layer and extending over at least part of the surface of the froth, and the process includes the step of directing a jet of liquid onto the plate-like surface in such a manner that the liquid is caused to be distributed over the plate-like surface, and to fall therefrom in a plurality of streams.

10. A process as claimed in claim 9 wherein the plate-like surface is provided with a plurality of downwardly extending fingers.

11. A process as claimed in claim 9 wherein the plate-like surface is orientated substantially horizontally above the froth layer and the jet of liquid is directed substantially vertically upwardly onto the plate-like surface.

12. A process as claimed in claim 10 wherein the liquid containing the particles is distributed directly into the froth layer, wherein the fingers are sized and positioned to extend downwardly into the froth layer in use.

13. A froth flotation separation process comprising the steps of:

generating a froth layer including particles introduced in the generation of the froth layer, sustaining the froth layer by providing a supply of bubbles rising into the froth layer;

providing a supply of liquid;

mixing further particles with the liquid; and distributing the liquid containing the further particles into or onto the froth layer in an array of streams as a separate step to the step of generating the froth layer, wherein the liquid containing the particles is distributed onto the froth layer by providing a tray adapted to contain the liquid, the tray extending substantially horizontally above the surface of the froth layer, the tray having an array of holes therethrough, pouring or distributing the liquid into the tray such that the liquid containing the particles is caused to drain through the holes and fall upon the froth layer, and vibrating the tray in such a manner as to shake loose particles which become caught in the holes in the tray.

14. A process as claimed in claim 13 wherein the amplitude and frequency of vibration is selected to minimize blocking the holes in the tray by the particles.

15. A process as claimed in claim 1 wherein the wash water is distributed into or onto the froth layer by apparatus comprising:

a plate-like surface adapted to be positioned above the froth layer, and a nozzle arranged to direct a jet of wash water upwardly against an underside of the surface such that the wash water is caused to be distributed over the surface, and the to fall from the surface in a plurality of streams.

16. A process as claimed in claim 15 wherein the plate-like surface is provided with a plurality of downwardly extending fingers arrayed such that in use, the wash water distributed over the surface strikes the fingers for causing the wash water to fall from the surface in the plurality of streams.

17. A process as claimed in claim 16 wherein the fingers each comprise rods located in a predetermined array across the surface.

18. A process as claimed in claim 17 wherein the array is predetermined to give an even distribution of wash water streams across the surface of the froth layer.

19. A process as claimed in claim 15 wherein the plate-like surface is provided with a peripheral downwardly extending flange arranged to contain the wash water distributed over the surface from the jet.

20. Apparatus for distributing liquid over a froth layer in a froth flotation separation process, said apparatus comprising:

a wash water tray having an array of holes therein, positioned above a surface of the froth layer;

means to supply the liquid to the wash water tray; and vibration means operatively connected to the wash water tray and adapted to vibrate the wash water tray in a manner predetermined to shake loose any particles in the liquid which might block up the holes in the tray.

21. Apparatus as claimed in claim 20 further comprising suspension means supporting the wash water tray for allowing the tray to be vibrated by the vibration means.

22. Apparatus as claimed in claim 20 wherein the vibration means comprise an electric motor and an eccentric weight rotated by the motor.

* * * * *